US012789956B2

(12) United States Patent
Centorbi et al.

(10) Patent No.: US 12,789,956 B2
(45) Date of Patent: Nov. 10, 2026

(54) INFLATABLE DOCK WITH INTEGRATED RAMP SYSTEM

(71) Applicant: ALBIE'S LLC, Farmington, UT (US)

(72) Inventors: Dominic Centorbi, Portland, OR (US); Camron Allen, Farmington, UT (US)

( * ) Notice: Subject to any disclaimer, the term of this patent is extended or adjusted under 35 U.S.C. 154(b) by 212 days.

(21) Appl. No.: 18/808,467

(22) Filed: Aug. 19, 2024

(65) Prior Publication Data

US 2026/0048825 A1 Feb. 19, 2026

(51) Int. Cl.
*B63C 1/02* (2006.01)

(52) U.S. Cl.
CPC ..... *B63C 1/02* (2013.01)

(58) Field of Classification Search
CPC ..... B63C 1/02; B63B 34/52
See application file for complete search history.

(56) References Cited

U.S. PATENT DOCUMENTS

| | | | | |
|---|---|---|---|---|
| 6,722,307 | B1 * | 4/2004 | Rogers | A01K 1/035 182/206 |
| D913,900 | S * | 3/2021 | Builder | D12/316 |
| D1,084,188 | S * | 7/2025 | Zhang | D21/803 |
| 2014/0094075 | A1 * | 4/2014 | Chen | B63B 34/56 441/129 |
| 2015/0121634 | A1 * | 5/2015 | Anastasia | B63B 35/00 14/69.5 |
| 2024/0124101 | A1 * | 4/2024 | MacRae | B63B 27/143 |
| 2024/0392596 | A1 * | 11/2024 | Schwimmer | E04H 4/144 |

* cited by examiner

*Primary Examiner* — Evan P Dzierzynski
(74) *Attorney, Agent, or Firm* — Shalchi Law PC; Ali Shalchi, Esq.

(57) ABSTRACT

An inflatable dock includes a docking platform with an inflation interface, a pair of arms, and an indentation positioned between the arms, a perimeter edge having a plurality of edge handles, a water-contacting surface opposing the docking platform and with the perimeter edge positioned between the docking platform and the water-contacting surface, an integrated ramp system positioned within the indentation and including a ramp structure with a plurality of ramp steps with at least two of the steps being weighted, and a plurality of attached metallic rings.

18 Claims, 6 Drawing Sheets

INFLATABLE DOCK WITH INTEGRATED RAMP SYSTEM

FIELD OF THE INVENTION

This disclosure relates to the field of inflatable aquatic devices and systems.

BACKGROUND

Inflatable aquatic flotation devices often present challenges when it comes to mounting them. Users frequently struggle to get onto these devices, especially in deeper water, due to their slippery surfaces and the lack of stabilizing elements. This can lead to frustration and even potential safety risks if someone is unable to mount the device quickly in an emergency situation.

Staying afloat on these devices can also be problematic. Many inflatable flotation devices are prone to tipping over or becoming unbalanced, especially if the user shifts their weight suddenly. This instability can make it difficult to relax and enjoy the water, as users must constantly adjust their position to maintain balance. Additionally, the size of these devices can vary greatly, and larger inflatables may be cumbersome to handle and transport, while smaller ones might not provide adequate support for all users.

Conventional inflatable flotation devices are also generally not pet-friendly. Pets, especially dogs, can easily puncture these devices with their claws, leading to deflation and potential safety hazards. Moreover, the above-mentioned instability and size issues can be exacerbated when pets are involved, as their unpredictable movements can further destabilize the device, making it even harder for both the pet and the owner to stay afloat comfortably. There is room for improvement in the field, to promote more enjoyable, safer, and overall enhanced aquatic activities.

SUMMARY

In one embodiment an inflatable dock is provided that is floatable on water and mountable by a user, the dock comprising a docking platform having a length and width with respective axes, the docking platform comprising a pair of arms extending lengthwise away from the docking platform, the docking platform further comprising an indentation positioned between the arms, the indentation receding lengthwise in and toward the docking platform, and the indentation being centrally aligned with the docking platform's length axis. The dock further comprises a perimeter edge running orthogonally to the docking platform along its length and width, the perimeter edge following the indentation along a recessed edge and a pair of parallel extended edges, the recessed edge running parallel to the docking platform's width, the extended edges running orthogonally to the recessed edge. The dock further comprises a water-contacting surface opposing the docking platform, the perimeter edge positioned between the docking platform and the water-contacting surface. The dock further comprises an integrated ramp system positioned within the indentation and comprising a ramp structure and joining structure, the joining structure connecting the ramp system to the perimeter edge, the ramp structure extending away from the inflatable dock such that the ramp structure is submerged below the water's surface when the dock is inflated and floated.

In one aspect of the inflatable dock, the joining structure comprises a plurality of edge loops, a plurality of ramp loops, and a joining cord running through both groups of loops, the edge loops attached to the perimeter edge, the ramp loops attached to the ramp structure. In another aspect of the inflatable dock, the perimeter edge comprises a plurality of edge handles. In yet another aspect, the ramp structure comprises a sunken portion and sloping portions, the sunken portion lying substantially flat and on a plane parallel to the docking platform, the sloping portions positioned at an angle between the perimeter edge and the sunken portion. In another aspect of the inflatable dock, the sunken portion comprises a plurality of ramp steps, the ramp steps being linearly aligned at regular intervals in a series, each ramp step having a length running parallel to the docking platform's width. In yet another aspect of the inflatable dock, the docking platform further comprises a plurality of attached metallic rings. In another aspect, the docking platform further comprises a plurality of platform handles positioned proximate to the perimeter edge. In yet another aspect, the docking platform further comprises an inflation interface. In another aspect, the dock is configured to be mountable by a human or a dog without assistance, by using the ramp steps to mount the ramp structure in order to reach the docking platform.

In another embodiment, an inflatable dock that is floatable on water comprises a docking platform comprising an inflation interface, a pair of arms, and an indentation positioned between the arms; a perimeter edge comprising a plurality of edge handles; a water-contacting surface opposing the docking platform, the perimeter edge positioned between the docking platform and the water-contacting surface; an integrated ramp system positioned within the indentation and comprising a ramp structure with a plurality of ramp steps; and a plurality of attached metallic rings.

In one aspect, the inflatable dock is configured to be mountable by a dog without assistance, by using the ramp steps to mount the ramp structure in order to reach the docking platform. In another aspect, the ramp system further comprises a joining structure, the joining structure comprising a plurality of edge loops, a plurality of ramp loops, and a joining cord running through both groups of loops, the edge loops attached to the perimeter edge, the ramp loops attached to the ramp structure. In another aspect, the docking platform has a length and width with respective axes, and wherein the ramp steps are linearly aligned at regular intervals in a series, each ramp step having a length running parallel to the docking platform's width. In yet another aspect, the pair of arms extends lengthwise away from the docking platform. In another aspect, the perimeter edge follows the indentation along a recessed edge and a pair of parallel extended edges, the recessed edge running parallel to the docking platform's width, the extended edges running orthogonally to the recessed edge. In yet another aspect, the ramp structure extends away from the inflatable dock such that the ramp structure is submerged below the water's surface when the dock is inflated and floated. In another aspect, the ramp structure further comprises a sunken portion and sloping portions, the sunken portion lying substantially flat and on a plane parallel to the docking platform, the sloping portions positioned at an angle between the perimeter edge and the sunken portion. In another aspect, the ramp steps are disposed upon the sunken portion. In yet another aspect, the metallic rings are attached to the docking platform. In another aspect, the docking platform further comprises a plurality of platform handles positioned proximate to the perimeter edge, and wherein the dock is configured to be mountable by a human without assistance, by using the ramp steps to mount the ramp structure in order to reach the docking platform.

DETAILED DESCRIPTION

In the following discussion, numerous specific details are set forth to provide a thorough understanding of the disclosed subject matter. However, those skilled in the art will appreciate that the present disclosed subject matter may be practiced without such specific details. In other instances, well-known elements, processes or techniques have been briefly mentioned and not elaborated on in order not to obscure the disclosed subject matter in unnecessary detail and description. Moreover, specific details and the like may have been omitted inasmuch as such details are not deemed necessary to obtain a complete understanding of the disclosed subject matter, and are considered to be within the understanding of persons having ordinary skill in the relevant art.

Embodiments of the present invention include an inflatable dock that is floatable on water and mountable by a plurality of users or passengers, including adults, kids, and dogs. Embodiments of the inflatable dock include a built-in ramp system having a size and shape designed to allow entry or mounting by humans & dogs without taking up a large portion of the dock. The ramp system is designed and angled to allow both humans and dogs to enter the dock unassisted. A plurality of handles and steps are strategically positioned on the dock and ramp entrance to aid in seamless entry and exits of the aquatic device.

Figure 1:
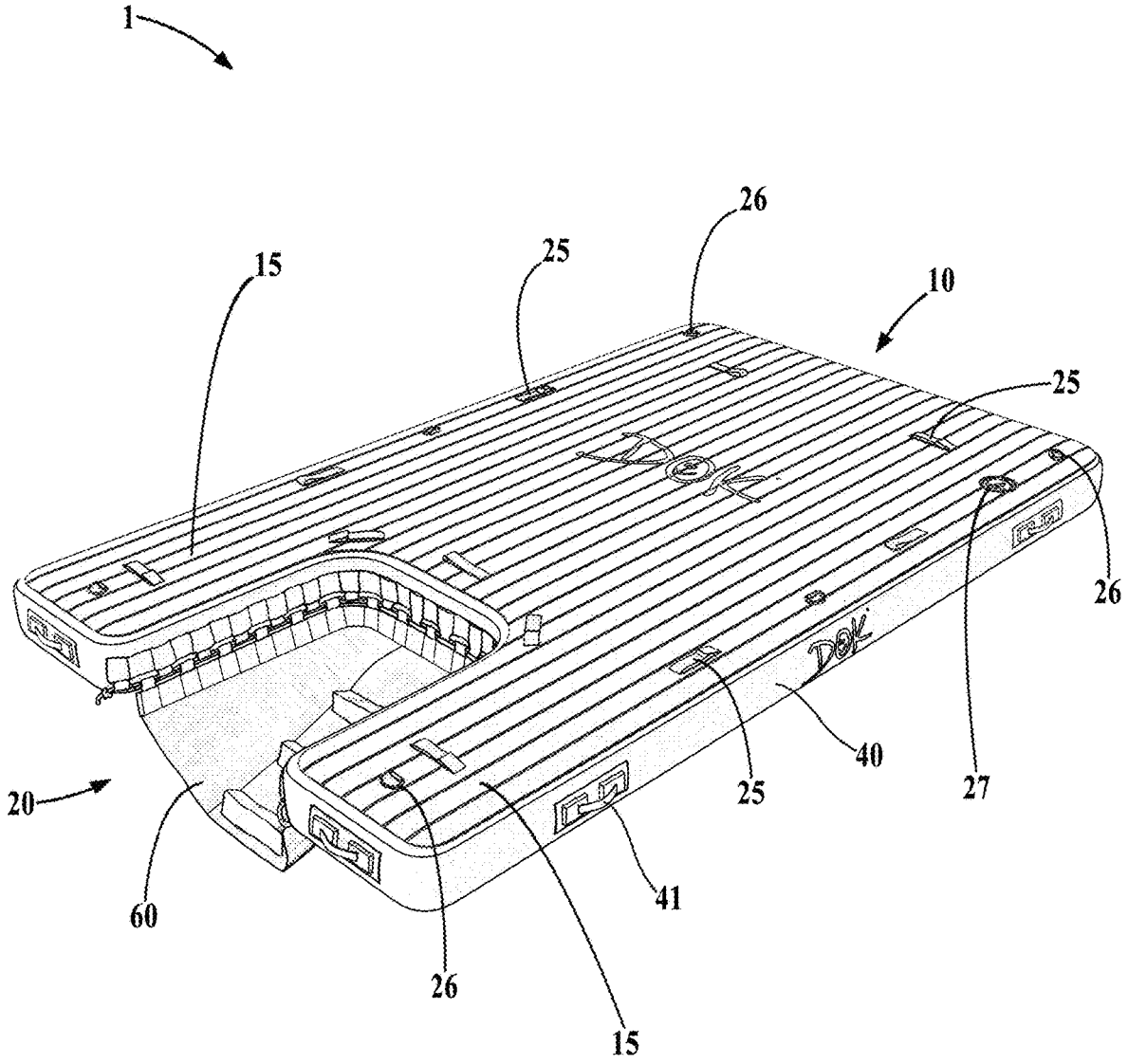
FIG. 1 illustrates a side perspective view of an inflatable dock with integrated ramp system in accordance with an embodiment of the present disclosure.

Referring to FIG. 1, a side perspective view highlights a top region of an inflatable dock 1 having an integrated ramp system 60, the dock having a substantially rectangular contour with rounded edges. The inflatable dock 1 comprises a mountable top surface or docking platform 10 having a length and width with respective axes, a perimeter edge 40 running orthogonally to the docking platform 10 along its length and width, and the integrated ramp system 60. The docking platform 10 defines the top region of the inflatable dock 1, and provides a mountable area that can be occupied by a plurality of users, the users usually sitting and/or lounging upon the platform. The depicted exemplary, and largest, embodiment of the inflatable dock 1 can ideally accommodate two to four people and one dog simultaneously. The docking platform 10 comprises a pair of rounded rectangular arms 15 extending lengthwise away from the docking platform. A rounded rectangular indentation 20 is formed and positioned between the arms 15, the indentation receding lengthwise in and toward the docking platform 10 and being centrally aligned with the docking platform's length axis. The perimeter edge 40 runs continuously all around the docking platform 10, including running along the indentation 20. The perimeter edge 40 thus has lengthwise and widthwise portions coinciding with the abovementioned length and width of the docking platform 10. The integrated ramp system 60 is positioned and attached within the indentation 20, and provides a first or initial mounting structure that is easily reached by a user swimming up to the floating dock 1, the ramp system having a mountable portion that is submerged, or approximately positioned at the level of the water's surface. In most embodiments, a mountable portion of the ramp system 60 is positioned in a range between the water's surface and slightly to moderately submerged (i.e. submerged several inches to a foot deep). The user thus utilizes the ramp system 60 as the first mounting structure in order to reach or mount the docking platform 10, or second mounting structure.

The inflatable dock 1 facilitates various mounting and riding activities by providing a plurality of handles found throughout the aquatic device. An exemplary perimeter edge 40 comprises a plurality of edge handles 41, each edge handle having a length running parallel to the docking platform 10. In an exemplary embodiment, each lengthwise and widthwise portion of the perimeter edge 40 comprises two edge handles 41, one of the two widthwise portions interrupted by the indentation 20. Additionally, some embodiments of the docking platform 10 further comprise a plurality of platform handles 25 positioned proximate to the perimeter edge 40, or less than 6 inches away from some portion of the perimeter edge, for most of the platform handles. Each platform handle 25 has a length, groups of two or more platform handles being linearly aligned along the handle lengths, and positioned along both the width and length of the docking platform 10. The platform handles 25 are geared more toward human usage than for animals, such as dogs. An exemplary dock 1 includes a larger concentration (i.e. an exemplary set of three to five) of platform handles 25 disposed proximate to the receded portion of the indentation 20, these providing more assistance for a person transitioning from the ramp system 60 to the docking platform 10. The docking platform 10 also further comprises a plurality of attached anchoring rings, or platform rings 26, each ring positioned near a platform handle 25 or linearly aligned with a series of platform handles, the handles and rings disposed in an alternating pattern. Exemplary platform rings 26 have a metallic composition and can facilitate anchoring of the inflatable dock 1 to a secondary structure, via cords or ropes threaded through the rings 26 and attached to the secondary structure. This provides a means for safely anchoring the inflatable dock 1 at a stationary position in the water, preventing undesirable drifting of the aquatic device. Finally, the docking platform 10 further comprises an inflation interface 27 through which air can be introduced or pumped from an external source, the pumped air inflating the dock 1. In an exemplary embodiment, the inflation interface 27 is positioned proximate to a corner of the docking platform 10, and substantially (within about an inch or two) linearly aligned with an alternating series of platform handles 25 and metallic platform rings 26.

Figure 2:
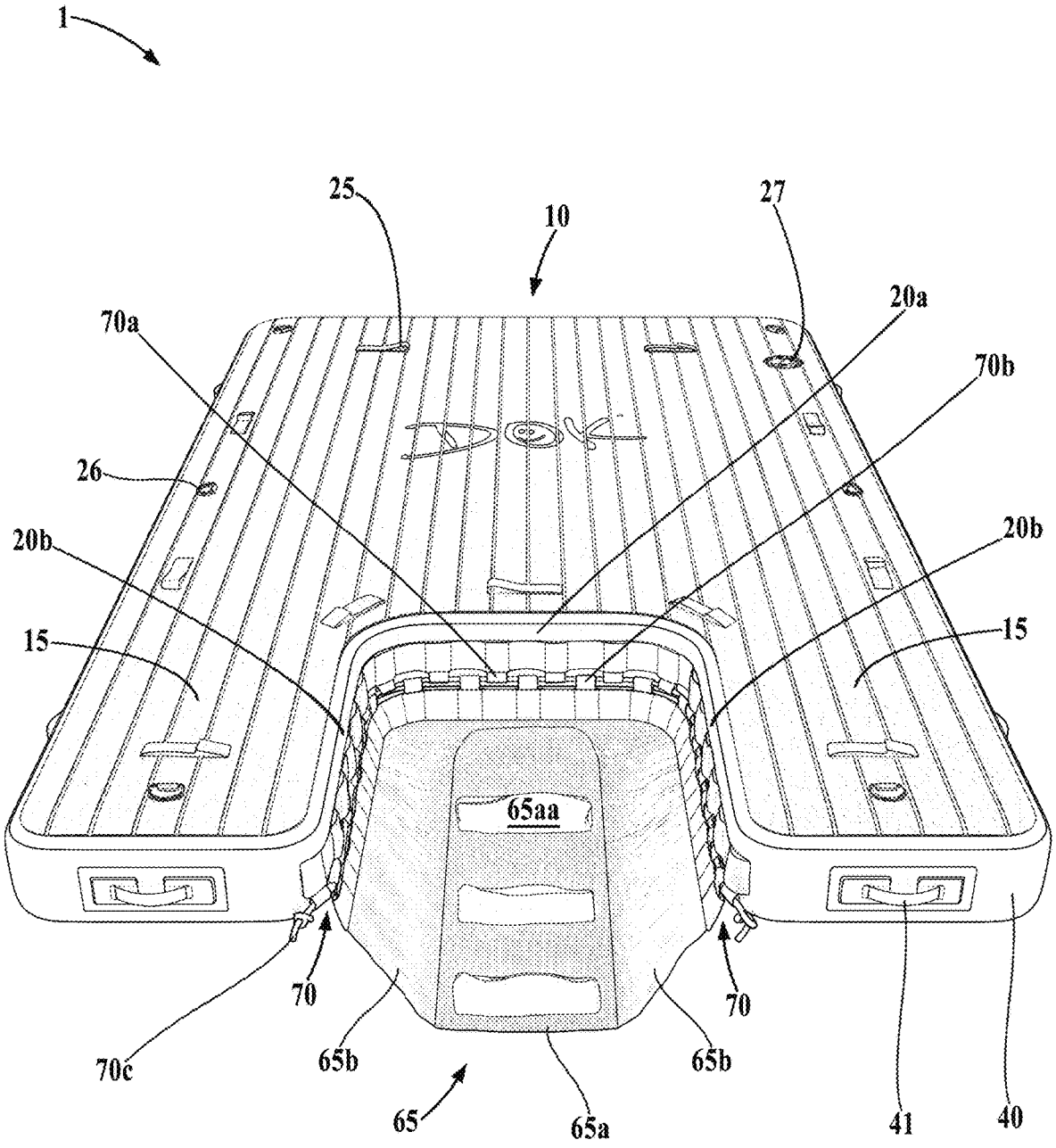
FIG. 2 illustrates a front perspective view of an inflatable dock with integrated ramp system in accordance with an embodiment of the present disclosure.

Referring to FIG. 2, a front perspective view shows an inflatable dock 1, the view highlighting the integrated ramp system comprising a ramp structure 65 and joining structure 70. The joining structure 70 connects the ramp system to the perimeter edge 40, the ramp structure 65 extending or dipping downward and away from the inflatable dock 1, such that the ramp structure is submerged below the water's surface when the dock is inflated and floated. The perimeter edge 40 follows, or coincides with, the indentation 20 along a recessed edge 20*a* and a pair of parallel extended edges 20*b*, or inner edges of the arms 15. The recessed edge 20*a* runs parallel to the width of the docking platform 10, the extended edges 20*b* running orthogonally to the recessed edge. The exemplary docking platform 10 is depicted with platform handles 25 and rings 26, along with the inflation interface 27.

The ramp structure 65 comprises a sunken portion 65*a* and sloping portions 65*b*, the sunken portion lying substantially flat and on a plane parallel to the docking platform 10, the sloping portions positioned at an angle between the indentation's coinciding perimeter edge 40 and the sunken portion, the joining structure 70 lying between the ramp structure 65 and the perimeter edge, the sunken portion lying centrally between the sloping portions. The sunken portion 65*a* includes a free edge lying furthest from or opposing the recessed edge 20*a* of the indentation 20, this free edge defining a border for a mountable entry portion of the sunken portion, whereby a passenger initially enters the craft. In some embodiments, the entire ramp structure 65, or a substantial portion of it, may be submerged underwater during actual aquatic usage of the dock 1. The sunken portion 65*a* has a length and width, and comprises a plurality of ramp steps 65*aa*, the ramp steps being linearly aligned at regular intervals in a series, each ramp step having a length running parallel to the width of the docking platform 10 and the sunken portion. An exemplary set of three ramp steps 65*aa* is shown in the illustrated embodiment. At least two of the ramp steps 65*aa* are weighted, each of the weighted ramp steps having an exemplary 3-part composition that includes a steel rod, a sponge material, and PVC exterior. During manufacture, the steel rod and sponge material are wrapped and covered by the PVC (that exterior portion of each ramp step visible in FIG. 2), the wrapped and/or sewn PVC securing the interior steel and sponge within.

In order to selectively promote submersion of the sunken portion 65*a*, the two weighted ramp steps 65*aa* are ideally positioned further from the recessed edge 20*a* than the unweighted ramp step (that ramp step 65*aa* being the only one labeled in FIG. 2), which sits proximate to the recessed edge 20*a*. This selective weighting causes the entry portion of the sunken portion 65*a* to sink further into the water, while the sunken portion beneath the unweighted ramp step 65*aa* (that ramp step closest to the body of the dock 1, or recessed edge 20*a* of the indentation 20) floats higher than the entry portion. Thus, the selectively weighted ramp steps cause the sunken portion 65*a* to slope upward toward the dock 1, coinciding with the sloping portions 65*b*. This cases passenger entry onto the ramp structure 65, as the passenger can swim toward the ramp structure, being level with or even higher than the entry portion of the sunken portion 65*a*, and mount the ramp structure from a sloped low to high position, at a comfortable ramp angle.

Both humans and dogs can utilize the ramp steps 65*aa* to initially mount the inflatable dock 1 via the ramp structure 65 before reaching the docking platform 10. A human user can also grasp the pair of perimeter edge handles 41 flanking the indentation 20 and ramp structure 65 in order to close their proximity to the ramp structure 65 before mounting it.

The joining structure 70 comprises a plurality of perimeter edge loops 70*a*, a plurality of ramp loops 70*b*, and a joining cord 70*c* running through both groups of loops in order to join and secure the ramp structure 65 to the inflatable dock 1. Each of the two protruding free ends of the cord 70*c* can be tied off or knotted to prevent sliding or loosening of the cord out of the loops. Exemplary edge loops 70*a* are attached to the perimeter edge 40 via an intermediary strip of material fixed to the edge 40, while the ramp loops 70*b* are attached to the ramp structure 65. The joining structure 70 lines the indentation 20, along the recessed edge 20*a* and the extended edges 20*b*.

Figure 3:
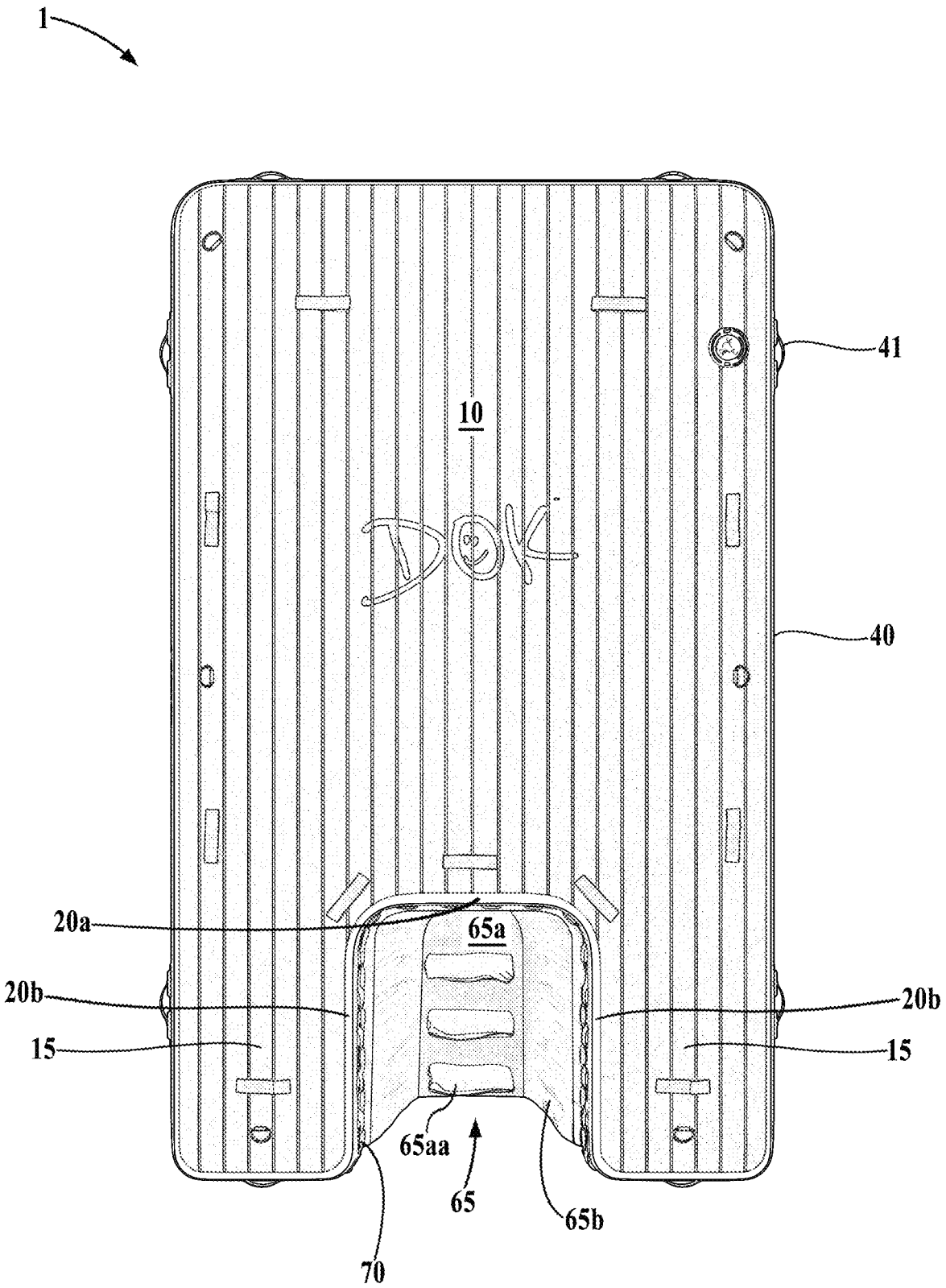
FIG. 3 illustrates a top view of an inflatable dock with integrated ramp system in accordance with an embodiment of the present disclosure.

Referring to FIG. 3, a top view shows an inflatable dock 1 with integrated ramp system having a ramp structure 65 comprising sunken portion 65*a* and sloping portions 65*b*, the ramp structure being attached to the dock 1 via joining structure 70. The sunken portion 65*a* includes the ramp steps 65*aa* which are well-suited to be stepped upon or initially grabbed by a person, or pawed or clawed by a dog, in order to mount the ramp structure and subsequently the docking platform 10. The top view highlights the dimensions of the arms 15 and centrally disposed indentation 20 with recessed edge 20*a* and extended edges 20*b*. The extended edges 20*b* run less than halfway along the full length of the docking platform 10. The perimeter edge 40 runs continuously around the docking platform 10 and includes the plurality of edge handles 41 disposed regularly along its entire path.

An exemplary inflatable dock 1 (an embodiment for both humans and pets) has a length dimension of approximately 8 feet and a width dimension of approximately 5 feet. The dock 1 can accommodate users up to a maximum weight-bearing capacity of approximately 550 pounds. The dock 1 can be deflated, flattened, and rolled up into a secured cylindrical tube form having dimensions of 13 inches by 44 inches, and a carrying weight of 32 pounds. This portable form of the dock can further be bagged, the bag including attached carrying straps or shoulder straps. For an inflation procedure, an electric pump is recommended in order to decrease setup time. The exemplary inflatable dock 1 is composed of a drop stitch material (PVC), the docking platform 10 including an EVA non-slip foam surface.

Figure 4:
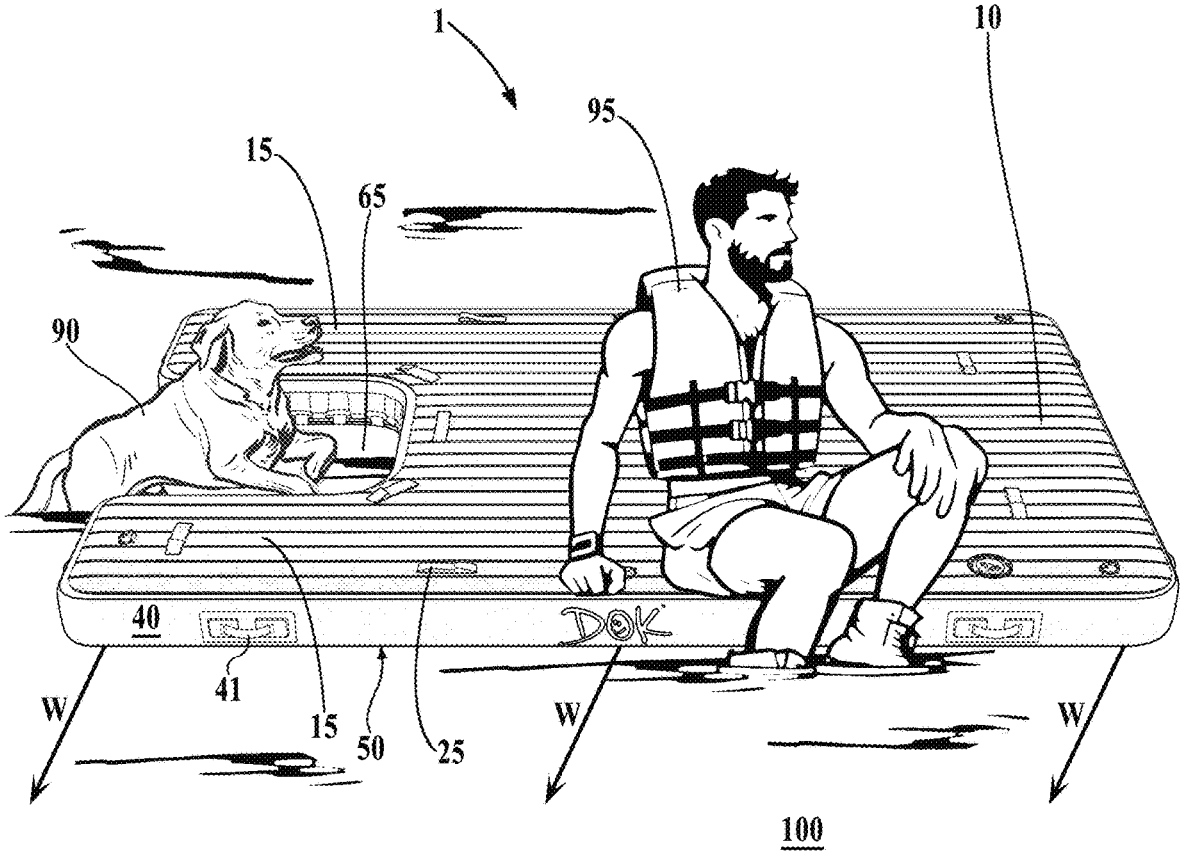
FIG. 4 illustrates a context view of an inflatable dock with integrated ramp system floating on water and being mounted by a dog and a person in accordance with an embodiment of the present disclosure.

Referring to FIG. 4, a context view shows an inflatable dock 1 with integrated ramp system, the dock floating on water 100 and being mounted by a dog 90 and a person 95. The inflatable dock 1 further comprises a water-contacting surface 50 opposing the docking platform 10 and mirroring its contour. The perimeter edge 40 is positioned between the docking platform 10 and the water-contacting surface 50. The inflatable dock 1 is well-suited to be mountable by a human or a dog on their own, without assistance from another user, by using the ramp steps 65*aa* to mount the ramp structure 65 in order to reach the docking platform 10. The person 95 shown sitting on the docking platform 10 can hold on to the platform handles 25 for stability while seated or re-orienting his body upon the platform. Perimeter edge handles 41 can be utilized in the same capacity, or more likely grasped by swimmers alongside the dock 1 who wish to navigate toward the ramp system 60 in order to join people 95 already occupying the docking platform 10. The platform handles 25 can further be utilized for initially mounting the dock 1 via the ramp system 60. A dog 90 is depicted climbing onto the ramp structure 65 positioned in the indentation 20 between the arms 15, mounting it alone using the ramp steps 65*aa* to subsequently reach and mount the docking platform 10. As the dog 90 mounts the exemplary ramp structure 65, which is submerged, her front then rear paws dip into the water even while standing upon the ramp structure. Lines W indicate the level of the water 100, which coincides with the water-contacting surface 50 of the dock 1, at a height or level that is higher than the ramp structure 65. The dog 90 can push off of the ramp steps 65*aa* to gain leverage and traction in order to elevate herself, reaching and mounting the docking platform 10 to join the human occupants 95.

Figure 5A:
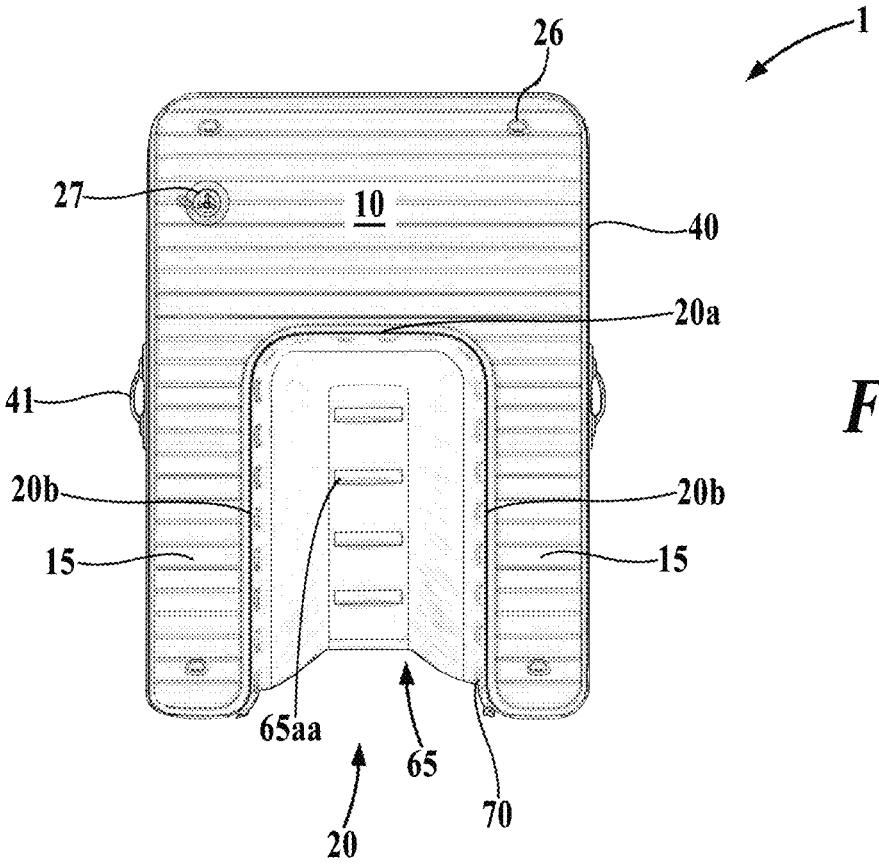
FIGS. 5*a-b* illustrate top views of alternate embodiments of inflatable docks with integrated ramp systems, each dock having a modified shape and size geared toward usage by a dog, in accordance with the present disclosure.
Figure 5B:
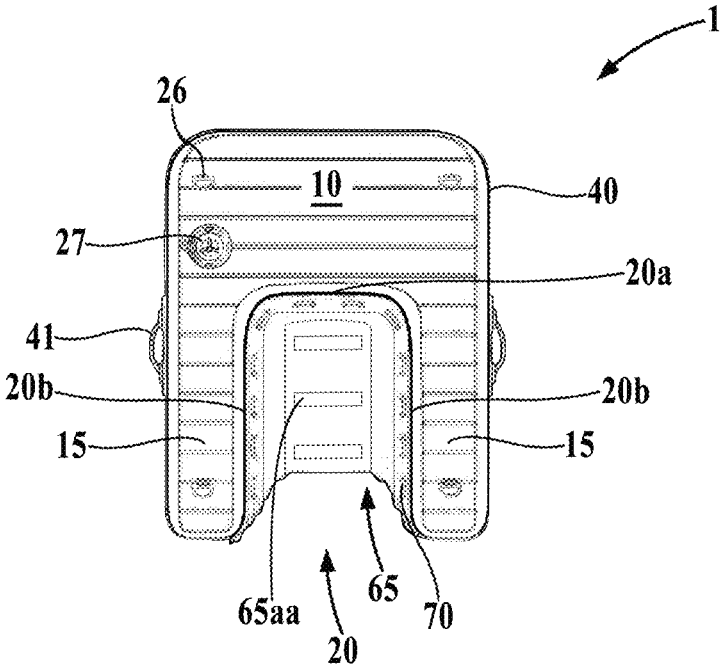

Referring to FIGS. 5*a-b*, top views show alternate embodiments of inflatable docks 1 with integrated ramp systems 60, each dock having a modified shape and size geared toward usage by a dog. Both depicted embodiments include an indentation 20 with a recessed edge 20*a* and extended edges 20*b*, the extended edges of each embodiment running more than halfway along the full length of the docking platform 10, the arms 15 occupying more than half of this length. Both depicted embodiments include a docking platform 10 comprising platform rings 26 for anchoring the docks 1, along with an inflation interface 27. Each embodiment has four platform rings 26 positioned proximate to the rounded corners of the docking platform 10. However, the two depicted embodiments both lack platform handles 25, which are more geared toward usage by a human, as illustrated in previous FIGS. Both depicted embodiments include a perimeter edge 40 comprising edge handles 41, each embodiment having a single edge handle per length edge 40. Both depicted embodiments include a ramp structure 65 that is connected to the dock 1 via joining structure 70, the ramp structure comprising ramp steps 65*aa*. The embodiment shown in FIG. 5*a* includes four ramp steps 65*aa*, while the embodiment shown in FIG. 5*b* includes three ramp steps, its dock 1 being generally smaller in size. The larger dock 1 shown in FIG. 5*a* is intended to accommodate dogs weighing up to 230 pounds, while the smaller dock 1 shown in FIG. 5*b* is geared toward dogs weighing up to 30 pounds.

Figure 6:
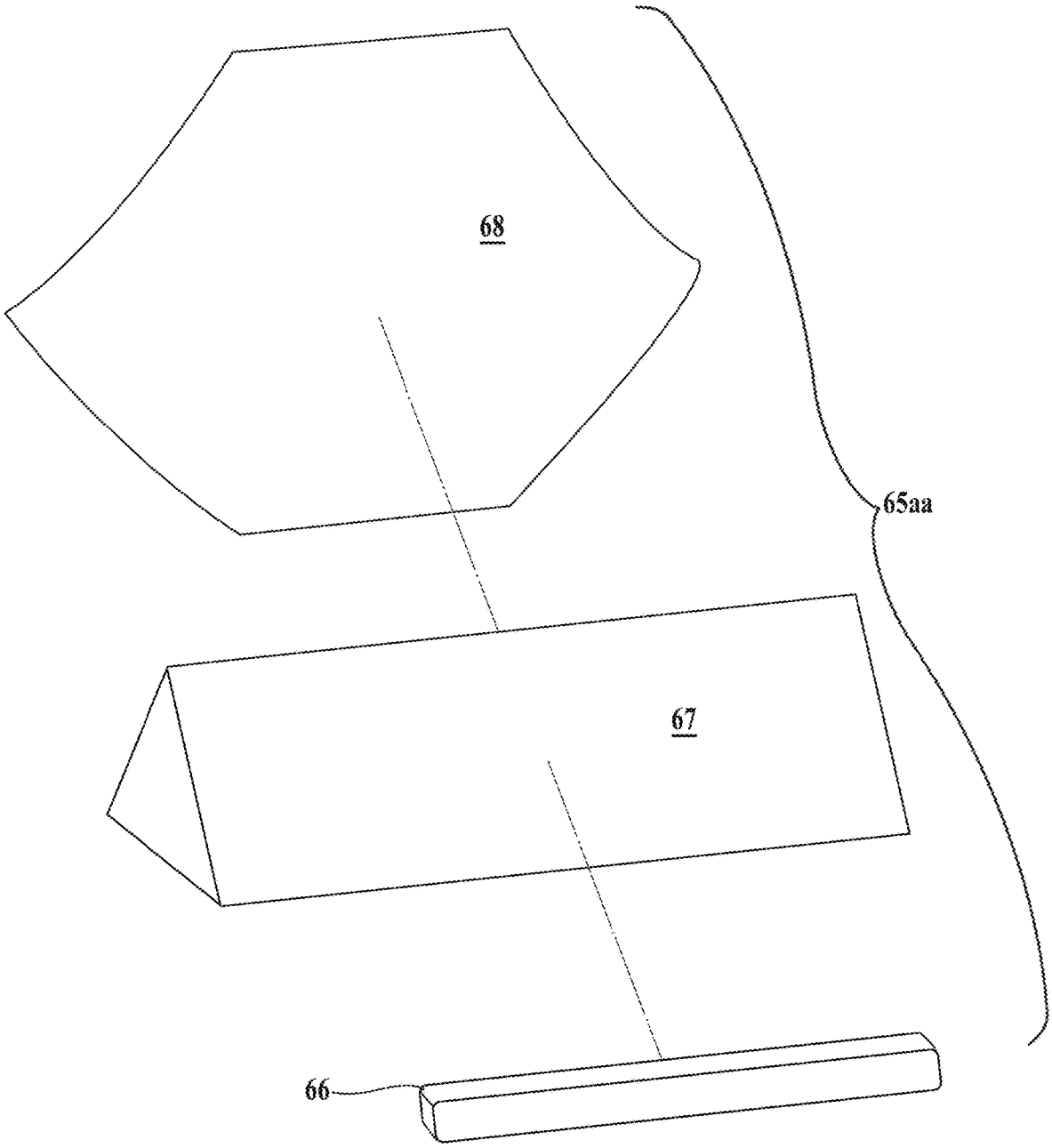
FIG. 6 illustrates an exploded perspective view of components that form the interior and exterior of a ramp step in accordance with an embodiment of the present disclosure.

Referring to FIG. 6, an exploded perspective view shows components that form the interior and exterior of a ramp step 65*aa*. The exterior consists of the aforementioned PVC sheet 68 that is wrapped around interior components and preferably sewn to the sunken portion 65*a* of the ramp structure 65. The interior components comprise the aforementioned sponge piece 67 and steel rod 66. An exemplary PVC sheet 68 is a hexagonal, flat piece of PVC that substantially conforms to the contours of the sponge piece 67, which has the exemplary shape of an extruded triangle. The steel rod 66 has a stainless-steel composition, and is preferably inserted or nested under the sponge piece 67 while the PVC sheet 68 is wrapped and sewn around both interior components during manufacture. An exemplary exterior for the steel rod 66 consists of a black PVC tube, which protects the steel and the ramp step 65*aa*, and prevents the bare steel from scratching any other contacted surfaces or components. An exemplary weight for each installed ramp step 65*aa* is 0.55 lbs. or 0.25 kg. This is the ideal weight for sinking and submerging the sunken portion 65*a* without adding too much total weight to the inflatable dock 1. An exemplary length for the steel rod 66 is 17 cm, with an exemplary diameter of 1.5 cm. Exemplary dimensions for the sponge piece 67 include a length of 25 cm and a height of 5.5 cm.

Many variations may be made to the embodiments described herein. All variations are intended to be included within the scope of this disclosure. The description of the embodiments herein can be practiced in many ways. Any terminology used herein should not be construed as restricting the features or aspects of the disclosed subject matter. The scope should instead be construed in accordance with the appended claims.

There may be many other ways to implement the disclosed embodiments. Various functions and elements described herein may be partitioned differently from those shown without departing from the scope of the disclosed embodiments. Various modifications to these implementations may be readily apparent to those skilled in the art, and generic principles defined herein may be applied to other implementations. Thus, many changes and modifications may be made to the disclosed embodiments, by one having ordinary skill in the art, without departing from the scope of the disclosed embodiments. For instance, different numbers of a given element or module may be employed, a different type or types of a given element or module may be employed, a given element or module may be added, or a given element or module may be omitted.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

The invention claimed is:

1. An inflatable dock that is floatable on water and mountable by a user, the dock comprising:

(a.) a docking platform having a length and width with respective axes, the docking platform comprising a pair of arms extending lengthwise away from the docking platform, the docking platform further comprising an indentation positioned between the arms, the indentation receding lengthwise in and toward the docking platform, the indentation being centrally aligned with the docking platform's length axis;

(b.) a perimeter edge running orthogonally to the docking platform along its length and width, the perimeter edge following the indentation along a recessed edge and a pair of parallel extended edges, the recessed edge running parallel to the docking platform's width, the extended edges running orthogonally to the recessed edge;

(c.) a water-contacting surface opposing the docking platform, the perimeter edge positioned between the docking platform and the water-contacting surface; and, (d.) an integrated ramp system positioned within the indentation and comprising a ramp structure and joining structure, the joining structure connecting the ramp system to the perimeter edge, the ramp structure extending away from the inflatable dock such that the ramp structure is submerged below the water's surface when the dock is inflated and floated, wherein the ramp structure comprises a sunken portion and sloping portions, the sunken portion lying substantially flat and on a plane parallel to the docking platform, the sloping portions positioned at an angle between the perimeter edge and the sunken portion.

2. The inflatable dock of claim 1, wherein the joining structure comprises a plurality of edge loops, a plurality of ramp loops, and a joining cord running through both groups of loops, the edge loops attached to the perimeter edge, the ramp loops attached to the ramp structure.

3. The inflatable dock of claim 2, wherein the perimeter edge comprises a plurality of edge handles.

4. The inflatable dock of claim 3, wherein the sunken portion comprises a plurality of ramp steps, the ramp steps being linearly aligned at regular intervals in a series, each ramp step having a length running parallel to the docking platform's width, at least two of the ramp steps being weighted.

5. The inflatable dock of claim 4, wherein the docking platform further comprises a plurality of attached metallic rings.

6. The inflatable dock of claim 5, wherein the docking platform further comprises a plurality of platform handles positioned proximate to the perimeter edge.

7. The inflatable dock of claim 6, wherein the docking platform further comprises an inflation interface.

8. The inflatable dock of claim 7, wherein the dock is configured to be mountable by a human or a dog without assistance, by using the ramp steps to mount the ramp structure in order to reach the docking platform, and wherein each of the weighted ramp steps has a 3-part composition that includes steel, sponge, and PVC, the steel and sponge being covered by the PVC.

9. An inflatable dock that is floatable on water, the dock comprising:

(a.) a docking platform comprising an inflation interface, a pair of arms, and an indentation positioned between the arms;

(b.) a perimeter edge comprising a plurality of edge handles;

(c.) a water-contacting surface opposing the docking platform, the perimeter edge positioned between the docking platform and the water-contacting surface;

(d.) an integrated ramp system positioned within the indentation and comprising a ramp structure with a plurality of ramp steps, at least two of the ramp steps being weighted, wherein the ramp structure further comprises a sunken portion and sloping portions, the sunken portion lying substantially flat and on a plane parallel to the docking platform, the sloping portions positioned at an angle between the perimeter edge and the sunken portion; and, (e.) a plurality of attached metallic rings.

10. The inflatable dock of claim 9, wherein the dock is configured to be mountable by a dog without assistance, by using the ramp steps to mount the ramp structure in order to reach the docking platform.

11. The inflatable dock of claim 10, wherein the ramp system further comprises a joining structure, the joining structure comprising a plurality of edge loops, a plurality of ramp loops, and a joining cord running through both groups of loops, the edge loops attached to the perimeter edge, the ramp loops attached to the ramp structure.

12. The inflatable dock of claim 11, wherein the docking platform has a length and width with respective axes, and wherein the ramp steps are linearly aligned at regular intervals in a series, each ramp step having a length running parallel to the docking platform's width.

13. The inflatable dock of claim 12, wherein the pair of arms extends lengthwise away from the docking platform.

14. The inflatable dock of claim 13, wherein the perimeter edge follows the indentation along a recessed edge and a pair of parallel extended edges, the recessed edge running parallel to the docking platform's width, the extended edges running orthogonally to the recessed edge.

15. The inflatable dock of claim 14, wherein the ramp structure extends away from the inflatable dock such that the ramp structure is submerged below the water's surface when the dock is inflated and floated.

16. The inflatable dock of claim 15, wherein the ramp steps are disposed upon the sunken portion, and wherein each of the weighted ramp steps has a 3-part composition.

17. The inflatable dock of claim 16, wherein the metallic rings are attached to the docking platform.

18. The inflatable dock of claim 17, wherein the docking platform further comprises a plurality of platform handles positioned proximate to the perimeter edge, and wherein the dock is configured to be mountable by a human without assistance, by using the ramp steps to mount the ramp structure in order to reach the docking platform.

* * * * *